US005628696A

United States Patent [19]

Frye

[11] Patent Number: 5,628,696

[45] Date of Patent: May 13, 1997

[54] GOLF PUTTER WITH BALL RETRIEVAL DEVICE

[76] Inventor: James E. Frye, 3640 W. Dublin St., Chandler, Ariz. 85226

[21] Appl. No.: 526,058

[22] Filed: Sep. 8, 1995

[51] Int. Cl.[6] ..... A63B 53/00

[52] U.S. Cl. ..... 473/286; 473/328

[58] Field of Search ..... 273/162 E; 473/286, 473/328

[56] References Cited

U.S. PATENT DOCUMENTS

| | | | |
|---|---|---|---|
| 1,531,821 | 3/1925 | Scott | 473/328 |
| 3,300,241 | 1/1967 | Eberwein et al. | 273/162 E |
| 3,374,027 | 3/1968 | Jacobs | 273/162 E X |
| 3,632,112 | 1/1972 | Jacobs | 273/162 E |
| 3,708,172 | 1/1973 | Rango | 273/162 E X |
| 3,841,639 | 10/1974 | Werner | 273/162 E |
| 4,580,784 | 4/1986 | Brill | 473/286 |
| 4,976,436 | 12/1990 | Serizawa | 273/162 E |
| 5,368,302 | 11/1994 | Thomas | 273/162 E |
| 5,380,009 | 1/1995 | Henry et al. | 473/328 X |

*Primary Examiner*—George J. Marlo
*Attorney, Agent, or Firm*—Schmeiser, Olsen & Watts

[57] ABSTRACT

In a golf putter the head of the putter has a receptacle having a shape which in part conforms to the shape of a golf ball and has an opening in the bottom of the putter head. The opening is adapted to partially receive a golf ball, the bottom surface of the club is raised across the front and rear portions of the receptacle which allows for the smooth movement of the putter over the grass.

3 Claims, 1 Drawing Sheet

GOLF PUTTER WITH BALL RETRIEVAL DEVICE

FIELD OF THE INVENTION

The present invention relates generally to golfing and golf clubs. In particular the present invention is a golf putter with ball retrieval de, vice built into the putter head.

BACKGROUND OF THE INVENTION

Due to its great popularity numerous devices and items have been developed for the sport of golfing. One area that has received a great deal of attention is ball retrieval devices. These devices come in a wide variety of styles but may be generally defined by the particular environment in which they operate.

The first type of ball retrieval devices to be discussed here are those which are used to retrieve golf balls from water hazards. The basic components of such devices generally include a telescoping type handle which enables the user to reach out far enough into the water hazard to retrieve the ball and an open net or cage-like device at one end of the handle which allows for drainage during the retrieval process.

A second type of ball retrieval device is utilized to accumulate a number of golf balls at one time. Such devices can be in the form of automatic sweepers which roll over the balls and sweep them up off the ground and into a bin. Another device of this type is often in the shape of an elongated tube which has a variable or pressure response opening at one end. In this latter device the tube opening is pressed over the ball, and by use of a type of "O" ring securement :means the ball is squeezed past the restricted opening and into the tube.

A third type of device is designed to pick the golf ball up off of the ground or from within the putting green golf ball cup. One type of device for accomplishing this function is a movable claw-type grabbing device which is attached to a pole. Generally, a trigger mechanism on the pole handle enables the user to open and close the claws in order to pick up the ball.

Thus, while a myriad of items have attempted to fill the need of providing an acceptable ball retrieval device, to date, none have achieved the type of success that would be expected. It is believed that the failure of these devices to achieve wide use and acceptance have been for several reasons.

Many of the devices are manufactured to stand alone and therefore must be purchased as an addition to one's golf clubs. Such an approach is not only more expensive, but also requires the golfer to carry an additional device in his golf bag.

One shortcoming of the claw-type device as discussed above as well as those devices which use "O" rings is that both can cause damage to the golf ball. More specifically, the claw mechanism can mark the ball when it is moved to its closed position and the "O" ring devices can mark the ball when it is being pushed through the restricted opening into the receptacle. Perhaps more importantly, one of the most common uses for such devices is in the retrieval of the golf ball from the putting green cup. However, where pressure must be applied to squeeze the ball past the restricted opening or where the claw is being operated it is possible to damage or disrupt the cup. For example, the constant pressure applied against the cup as one tries to push the ball past the restricted opening can cause the cup to become more recessed or alternately may result in a tilting of the cup.

Similarly, the claw can engage the drainage openings normally found in the cup and upon removal of the claw the cup may become tilted or otherwise dislodged.

Further difficulties are often encountered when trying to incorporate a ball retrieval feature directly into the golf club. While this approach is generally attempted in order to overcome the aforementioned drawbacks of the stand alone device, it can only be successful if the effectiveness of the club is not diminished.

Accordingly, it is an objective of this invention to incorporate a ball retrieval feature into a golf club without diminishing the ability of the club to fulfill its primary function.

Another object of this invention is to develop a ball retrieval device which can be used without damaging the ball being retrieved.

Yet a further object of this invention is to develop a retrieval device which can be used to retrieve a ball from the putting green cup without dislodging or otherwise disrupting the position of the cup.

These and other objects are accomplished with the subject invention as will become apparent from a study of this disclosure.

SUMMARY OF THE INVENTION

The subject invention overcomes the difficulties that were found in prior devices and provides additional benefits not previously obtainable. This is accomplished through the placement of a golf ball receptacle in the base of a golf putter.

In the subject invention the opening of the receptacle has an outer circumference at the bottom surface of the club head. The edge of the outer circumference may be rounded for smoother putting. The diameter of the outer circumference is 1.65 inches. Portions of the receptacle are sized to conform to the outer surface of a golf ball. Thus, a standard golf ball which is between 1.70 and 1.75 inches in diameter will engage the outer circumference as the portion of the ball which is in the receptacle begins to contact portions of the inner surface of the receptacle. This occurs before the ball is halfway into the receptacle.

These features allow the user to pick up a golf ball by simply laying the club on top of the ball such that the ball moves into the receptacle. However, no additional force beyond the weight of the club needs to be placed on the ball in order to have the ball grasped by the club with sufficient strength to lift the ball off the ground. While this is easily accomplished with the subject club which in its preferred embodiment weighs 19 ounces it has been found that a weight of even 4 ounces is sufficient to engage the ball so as to allow to be lifted.

The size of the club head which, in its largest measurement, is 3.75 inches from heel to toe allows the user to easily place file club head into a standard 4 inch diameter putting green cup. As previously explained, since the ball can be sufficiently engaged simply by the weight of the club there is no effect on the putting green cup.

For these reasons, the subject invention provides a combined putter and ball retrieval device which can engage the ball sufficiently to lift it without needing to add additional pressure beyond the weight of the golf club.

Relative to the functioning of the club as a putter it was discovered that simply placing a hole in the bottom of the putter head would cause a ridge that could result in scuffing or the catching of the club on the grass as the putt was being made. Furthermore, it was discovered that the opening in the bottom can affect the alignment of the club head as the club moves over the grass. More specifically, because the opening is circular, as the club moves across the grass additional friction may be applied on one portion of the circular opening which will have a tendency to cause the club head to angle or cant. To overcome this the subject invention has an arc in the bottom surface of the club at the portions of the receptacle opening near the striking face of the club as well as the opposing side which is the back of the club. Thus, as the putter moves across the grass it actually engages the grass toward the heel and toe portions of the club which are beyond the receptacle and therefore the effect of the club is identical to that which would be obtained using a club that did not have a ball retrieval opening.

A BRIEF DESCRIPTION OF THE DRAWINGS

These and other advantages of the present invention will become more readily apparent upon reading the following detailed description and upon reference to the drawings in which.

DETAILED DESCRIPTION OF THE PREFERRED EMBODIMENT

The subject invention discloses a golf putter generally designated a 10. The putter 10 has a putter head 12 which, at its heel portion 14 is attached to a putter shaft 16.

Figure 1:
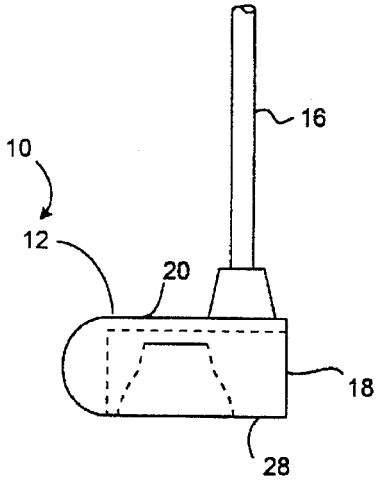
FIG. 1 is a side elevational view of the subject invention showing the receptacle in phantom.

As shown in FIG. 1 the putter head is semi-cylindrical in configuration and the head 12 has a front ball striking face 18 and a top surface 20. Inlaid in the top surface 20 are directional strips 22 which in the preferred embodiment are made of brass.

Inserted into the head is a unitary brass insert 24 which provides the striking face 18 as well as the golf ball receptacle 26.

Figure 3:
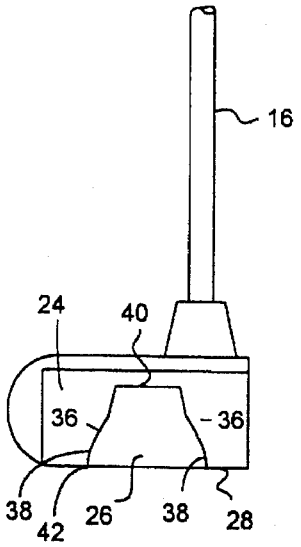
FIG. 3 is an enlarged cross-sectional view taken along lines 3—3 of FIG. 2 of the present invention.
Figure 2:
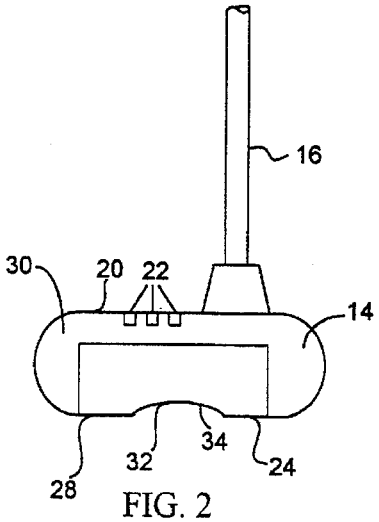
FIG. 2 is a front elevational view of the subject invention.

As shown in FIG. 2 the receptacle 26 opens at the bottom 28 of the head 12. FIG. 3 shows the striking face 18 and its relative to the club head 12. In the preferred embodiment the toe portion 30 of the putter head 12 is opposite of the heel portion 14 and the distance from the end of the heel portion to the end of the toe portion is 3.625 inches. In the preferred embodiment the entire insert 24 is made of brass.

As shown in FIG. 2 there is an arch 32 in the bottom 28. The arch spans essentially from one side of the receptacle 26 which is toward the heel portion 14 to the opposite side of the receptacle 26 which is toward the toe portion 30. The center 34 of the arch 32 is raised 0.025 inches from the bottom surface 28 toward the top surface 20.

As shown in FIG. 1 the striking surface 18 is angled from the bottom to the top 3 degrees from a vertical line to give the ball lift when putting.

As shown in FIG. 3 the receptacle 26 has sidewalls 36. The portions of the sidewall 36 which are immediately adjacent to the bottom 28 are curved as at 38. This curvature extends for approximately 0.4 inches and has a radius substantially equal to a golf ball 37 having a 1.70 inch diameter 39. The curved portions 38 curve inwardly toward the receptacle top 40 and serve as added points of contact as the outer diameter 42 of the receptacle 26 engages the golf ball 46.

Figure 4:
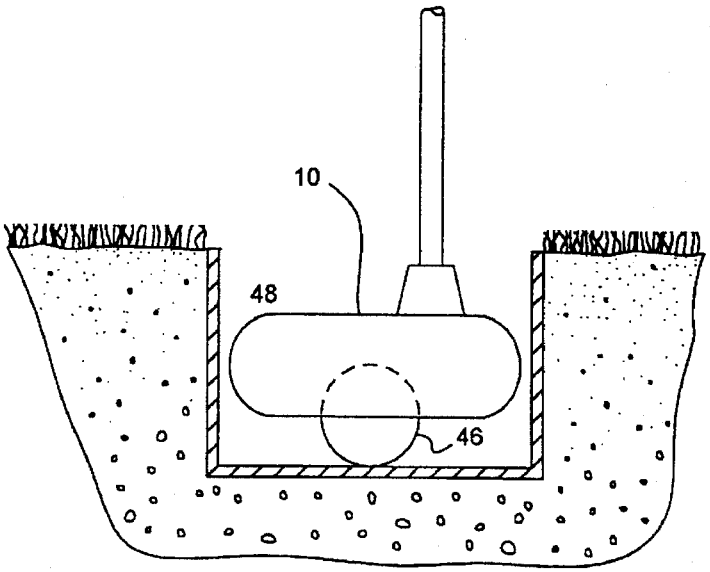
FIG. 4 is a front elevational view showing the subject invention being used to engage a golf ball within a putting green cup.

As shown in FIG. 4 the putter head 10 fits within a typical putting green cup 48 since the cup is circular and generally 4.0 inches in diameter whereas the largest portions of the putter head 12 from the toe portion 30 to the heel portion 14 is only 3.75 inches. Once the ball is gripped by the club head 12 the ball may be removed from the cup 48. It should be noted that FIG. 4 is for illustrative purposes only to the extent that it discloses the putting green cup since most cups have various water drainage holes and are configured to center the golf ball in the middle of the cup which makes the use of the subject invention even more effective.

The combination of the above features along with a typical golf ball which has either a surlyn or blata outer surface which is textured enables the balls to be picked up even though less than half of it enters the receptacle 26. The subject invention works equally well with a standard 1.700 inch diameter golf ball as with a 1.750 inch diameter magna golf ball, however, with the larger ball the primary point of contact is at the outer circumference. In the subject invention the weight of the putter 10, which in the preferred embodiment is 19 ounces, is sufficient to cause the receptacles inner circumference to grip the golf ball with sufficient friction to allow it to be lifted and removed from the putting green cup 48.

In operation, the golfer simply uses the putter as a normal putter. The raised portion of bottom surface 28 allows the club to slide smoothly over grass surfaces without catching in the receptacle 26. Once the putting has been completed and the golf ball 46 is in the cup 48 the user simply allows the putter head 12 to enter the cup. The weight of the putter 10 alone will secure the golf ball 46 within the receptacle 26. The golfer then would raise the club head, having applied no additional pressure beyond the weight of the club, in order to withdraw the ball and retrieve it.

The embodiment disclosed herein has been discussed for the purpose of familiarizing the reader with the novel aspects of the invention. Although preferred embodiments of the invention have been disclosed, many changes, modifications and substitutions may be made by one having ordinary skill in the art without necessarily departing from the spirit and scope of the invention as described in the appended claims.

I claim:

1. A golf putter with a ball retrieval element comprising

A shaft;

A putter head attached to said shaft, said head having a front ball striking surface, a back side opposite the front surface, a top surface and a bottom surface, a heel side where the shaft attaches and a toe side opposite said heel;

A receptacle within the putter head, said receptacle having an opening in said bottom surface whereby said receptacle is adapted to partially receive a golf ball, said opening having an outer circumference of predetermined dimensions; and An arch in said bottom surface said arch spanning from about one side of the receptacle which is toward the heel to about the other side of the receptacle which is toward the toe, such that the portions of the bottom toward the heel and toe extend beyond the portions of the bottom about the receptacle and said arch is open to said ball striking face and back side.

2. The invention of claim 1 wherein the receptacle has sidewalls curved inwardly toward the center of the receptacle.

3. The invention of claim 1 wherein the striking surface is angled to provide lift to a golf ball when putting.

* * * * *